US005435700A

United States Patent [19]

Park

[11] Patent Number: 5,435,700

[45] Date of Patent: Jul. 25, 1995

[54] REFRIGERANT SUCTION AND DISCHARGE APPARATUS FOR A HERMETIC COMPRESSOR

[75] Inventor: Seong G. Park, Seoul, Rep. of Korea

[73] Assignee: Goldstar Co., Ltd., Seoul, Rep. of Korea

[21] Appl. No.: 230,733

[22] Filed: Apr. 21, 1994

[30] Foreign Application Priority Data

Apr. 24, 1993 [KR] Rep. of Korea ..... 1993-6913
Apr. 30, 1993 [KR] Rep. of Korea ..... 1993-7458

[51] Int. Cl.[6] ..... F04B 53/00
[52] U.S. Cl. ..... 417/312; 181/403
[58] Field of Search ..... 417/312, 313, 902; 181/403, 229

[56] References Cited

U.S. PATENT DOCUMENTS

| | | | |
|---|---|---|---|
| 2,198,258 | 4/1940 | Money | 62/296 |
| 3,044,688 | 7/1962 | Frank et al. | 417/363 |
| 3,075,686 | 1/1963 | Steinhagen | 417/363 |
| 3,817,661 | 6/1974 | Ingalls | 417/312 |
| 4,281,972 | 8/1981 | Jacobs | 417/902 |
| 4,313,715 | 7/1982 | Richardson, Jr. | 417/312 |
| 4,370,104 | 1/1983 | Nelson et al. | 417/312 |
| 4,401,418 | 8/1983 | Fritchman | 417/312 |
| 4,412,791 | 11/1983 | Lai | 417/312 |
| 5,207,564 | 5/1993 | Fritchman | 417/312 |
| 5,252,035 | 10/1993 | Lee | 181/403 |
| 5,288,212 | 2/1994 | Lee | 417/312 |
| 5,341,654 | 8/1994 | Hewette | 417/312 |
| 5,344,289 | 9/1994 | Fasce | 417/312 |

*Primary Examiner*—Richard A. Bertsch
*Assistant Examiner*—Peter Korytnyk

[57] ABSTRACT

A refrigerant suction and discharge apparatus for a hermetic compressor includes a suction pipe drawing refrigerant from the exterior of the hermetic compressor, a suction muffler having a hollow cavity at one side and, another side, an intake opening provides a communication into a suction chamber, and at least two guide pipes positioned adjacent to the outlet opening of the suction pipe to refrigerant gas from the suction pipe gas into the suction muffler.

6 Claims, 6 Drawing Sheets

REFRIGERANT SUCTION AND DISCHARGE APPARATUS FOR A HERMETIC COMPRESSOR

BACKGROUND OF THE INVENTION

The present invention relates to a refrigerant suction and discharge apparatus of a hermetic compressor for high efficiency and noise reduction according to the application of a new refrigerant.

A conventional hermetic compressor includes a casing 1 comprising a lower half-shell 2 and an upper half-shell 3, wherein the two shells are hermetically joined as shown in FIG. 1, and a compression mechanism 4 having a crankshaft 6 and an electric motor mechanism 5 rotating the crankshaft 6 are positioned at the upper and lower parts respectively of a frame 7 disposed in the internal central portion of the casing 1.

The compression mechanism 4 includes a cylinder 9, a piston 10 reciprocating within the cylinder 9, and a slider 11 reciprocating the piston 10 according rotation of the crankshaft 6, and the electric motor mechanism 5 includes a rotor 12 and a stator 13 for rotating the crankshaft 6 by means of induced magnetism. To the lower portion of the crankshaft 6 is attached a propeller 17 drawing oil 15 in the bottom of the lower half-shell 2 through a central hole 16 of the crankshaft 6.

The rotation of the crankshaft 6 reciprocates the piston 10 within the cylinder 9 resulting in repeated suction, compression, and discharge of refrigerant gas. During this operation, noise is emitted so that means for reducing noise is mounted at a cylinder head.

FIG. 2 shows a conventional refrigerant suction and discharge passageway and means for reducing noise, which are disposed at the cylinder head, according to the movement direction of refrigerant gas.

The conventional refrigerant suction and discharge apparatus and means for reducing noise comprise a suction muffler 20 having a suction inlet opening 22, a suction chamber 24 as a space drawing refrigerant gas, a compression chamber 25 compressing the refrigerant gas drawn from the suction chamber 24 by compression force of the piston 10, a discharge chamber 26 as a space releasing the refrigerant gas in the compression chamber 25, a head cover 29 enclosing the outer space of the cylinder head and guiding the refrigerant gas, a discharge muffler 21 reducing noise of discharge gas, and a discharge pipe 31 guiding the discharge gas delivered from the discharge muffler 21.

In the conventional hermetic compressor, the rotor 12 and the crankshaft 6 is rotated by electric power, and the piston 10 reciprocates within the cylinder 9 by means of a scotch yoke mechanism according to the rotation of the crankshaft 6, resulting in repeated suction, compression, and discharge of refrigerant gas.

That is, after the refrigerant gas drawn into the casing 1 through a suction pipe 30 fills up the interior of the casing 1, it is drawn through the suction muffler 20 into the cylinder 9 in which it is compressed by the piston 10, and is discharged through the discharge muffler 21.

However, in the aforementioned conventional hermetic compressor, the refrigerant gas fills up the interior of the casing 1 prior to suction, the suction inlet opening 22 of the suction muffler 20 positioned at the upper half-shell 3 is considerably apart from the suction pipe 30 positioned at the lower half-shell 2, and a suction line 23 of the suction muffler 20 is curved and elongated, and thus the distance from suction to discharge is long.

As a result, the refrigerant gas movement is delayed and the gas is overheated, the ratio volume of the gas is increased and the density is decreased, resulting in lowered heat efficiency. Additionally, since the suction inlet opening 22 of the suction muffler 20 cannot guide suction gas from the suction pipe 30 properly, the quantity of the suction gas is small.

Furthermore, because the compression ratio, which has an effect on noise, is about 2.5 times as large R-134*a* as for R-12 and the noise value increases on account of changing conventional refrigerant (R-12) into new refrigerant (R-134*a*). As a result noise reduction by means of the suction muffler 20 and the discharge muffler 21 is no longer satisfactory.

That is, noise is reduced by lowering refrigerant density through mufflers, but noise reduction for new refrigerant (R-134a) is restricted because of the high compression ratio for R-134a refrigerant as compared with R-12.

SUMMARY OF THE INVENTION

It is an object of the present invention to provide a hermetic compressor with means positioned on a cylinder head to reduce increased noise resulting from the elevated compression ratio according to the application of a new refrigerant.

It is another object of the present invention to increase the efficiency of a hermetic compressor by shortening the movement distance of refrigerant from a suction pipe to a cylinder head.

In order to achieve these aforementioned objects of the invention, there is provided a refrigerant suction and discharge apparatus of a hermetic compressor comprising a suction pipe drawing refrigerant from the exterior of the hermetic compressor, a suction muffler having a hollow cavity at one side and an intake opening at the other side and providing communication into a suction chamber, and one at least two guide pipes located adjacent to the outlet opening of the suction pipe disposed in the interior of the hermetic compressor to introduce suction gas into the suction muffler.

BRIEF DESCRIPTION OF THE DRAWINGS

FIGS. 5(*b*) and 7(*b*) are cross-sections taken along the lines A—A in FIG. 5(*a*) and B—B in FIG. 7(*a*) respectively.

DETAILED DESCRIPTION OF THE INVENTION

The refrigerant suction and discharge apparatus for a hermetic compressor according to the present invention is described in detail for preferred embodiments with accompanying drawings.

Figure 3:
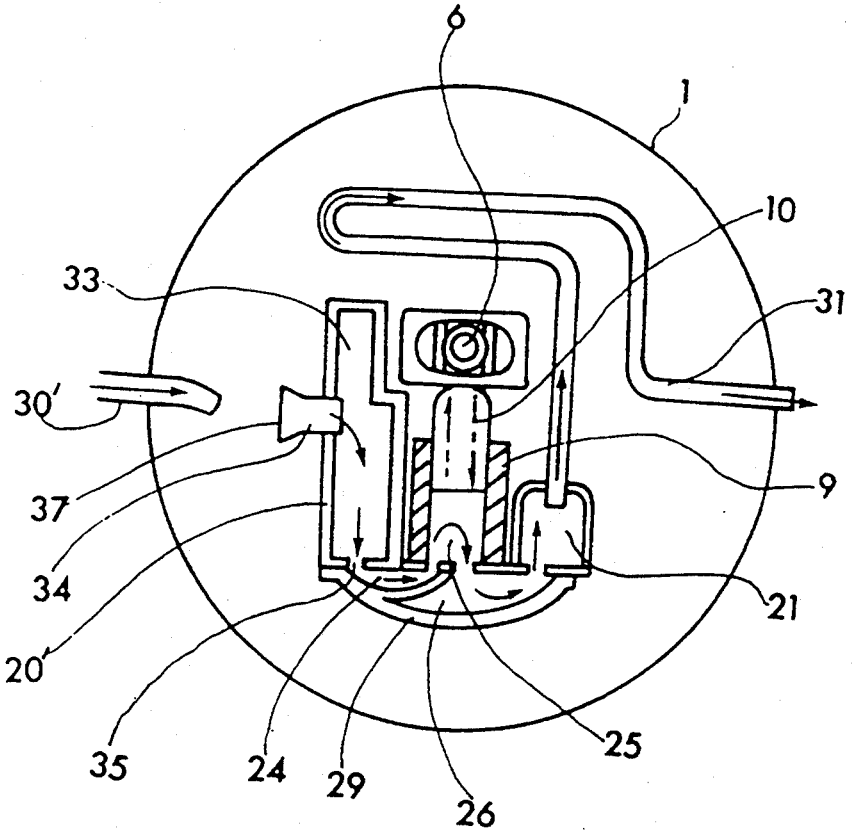
FIG. 3 is a cross-sectional view of a refrigerant suction and discharge apparatus for a hermetic compressor according to the present invention.
Figure 4:
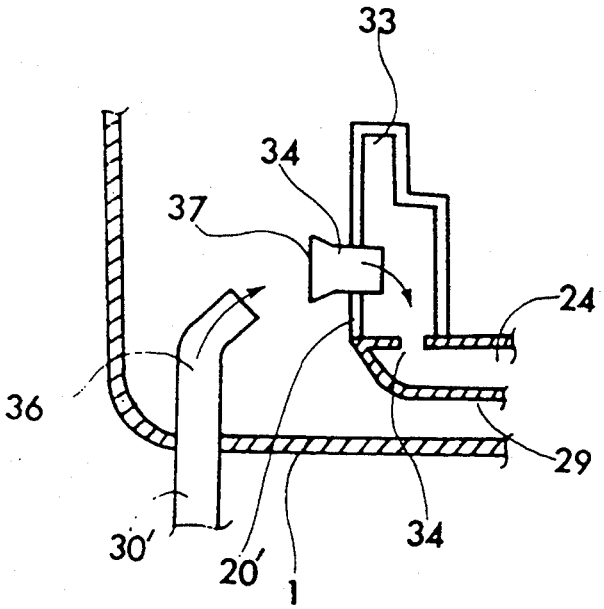
FIG. 4 is an enlarged fragmentary sectional view of a refrigerant suction and discharge apparatus for a hermetic compressor according to the present invention.

The refrigerant suction and discharge apparatus according to the present invention includes means for reducing noise and guiding refrigerant. As shown in FIGS. 3 and 4, means for reducing noise includes a suction muffler 20' having a hollow cavity 33 at one side which is a prescribed space for dampening movement noise of refrigerant and a guide pipe 34 for drawing refrigerant to thereby introduce the refrigerant gas into a suction chamber 24 through an intake opening 35. A means for guiding refrigerant includes a suction pipe 30', which is elongated into the interior of a casing 1 and has a guide portion 36 in the form of flexible curved line positioned adjacent to the guide pipe 34 of the suction muffler 20' and an expansion portion 37 at one end of the guide pipe 34 to increase the suction space of the refrigerant from the suction pipe 30', resulting in a first incremental increase of suction efficiency.

That is, refrigerant gas is introduced directly into the guide pipe 34 by means of the elongated suction pipe 30' and the curved guide portion 36 positioned adjacent to the guide pipe 34 of the suction muffler 20', resulting in rapid movement of refrigerant gas and an incremental and increment increase of heat efficiency. The noise of refrigerant gas is dampened by means of the hollow cavity 33 of the suction muffler 20' and the refrigerant gas is introduced directly into the suction chamber 24 through the intake opening 35.

Without departing from the scope of the present invention, a direct suction structure can be formed by means of elongation of the suction pipe 30' and installation of other supplementary parts on the suction muffler 20', the form of the guide pipe 34 can be any form, including spherical, and the guide pipe 34 is preferably made out of a non-metal material to increase heat efficiency.

Figure 5A:
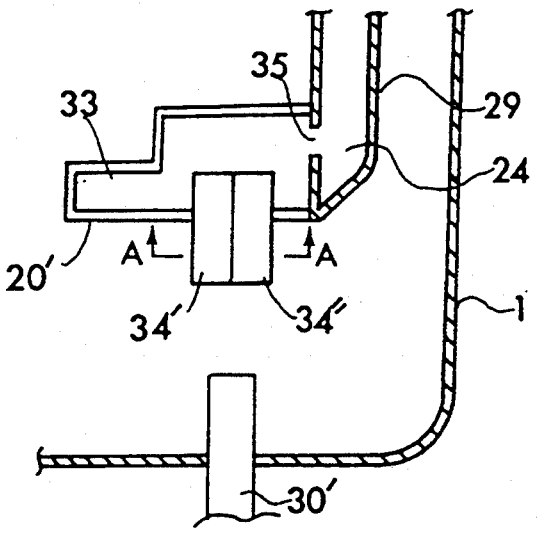
FIGS. 5(*a*), 6, 7(*a*), 8(*a*) and 9 are enlarged fragmentary sectional views of refrigerant suction and discharge apparatuses for a hermetic compressor showing other embodiments of the present invention.
Figure 5B:
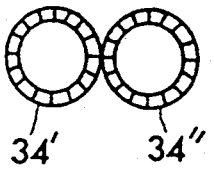

In the another embodiment of the present invention shown in FIGS. 5(*a*) and 5(*b*), the refrigerant suction and discharge apparatus comprises suction pipe 30' penetrating the casing 1 and introducing refrigerant gas into the interior of the casing 1, the suction muffler 20' having the hollow cavity 33 at one side and, at another side, the intake opening 35 which provides communication into the suction chamber 24, and at least two guide pipes 34' and 34'' positioned at the suction muffler 20' and adjacent to the outlet opening of the suction pipe 30'.

Additional refrigerant gas drawn from the suction pipe 30' is introduced into the suction muffler 20' by means of at least two guide pipes 34' and 34''.

Figure 6:
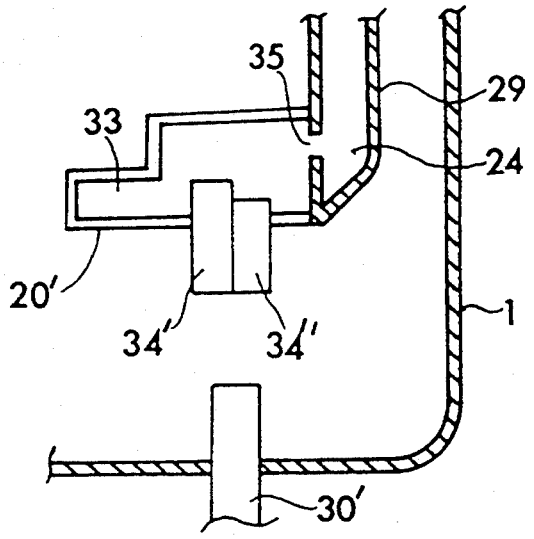
FIG. 6 is similar to FIG. 7(*a*), showing guide pipes 34' and 34'' in different lengths.
Figure 7A:
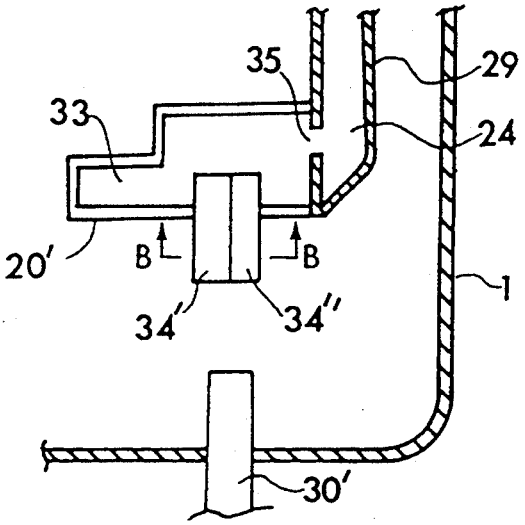
Figure 7B:
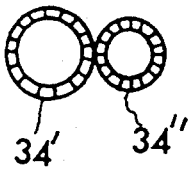

As shown in FIG. 6 and FIGS. 7(*a*) and 7(*b*), the guide pipes 34' and 34'' which are different in lengths or diameters, increase the noise reduction by an interference effect according to phase difference.

Figure 8A:
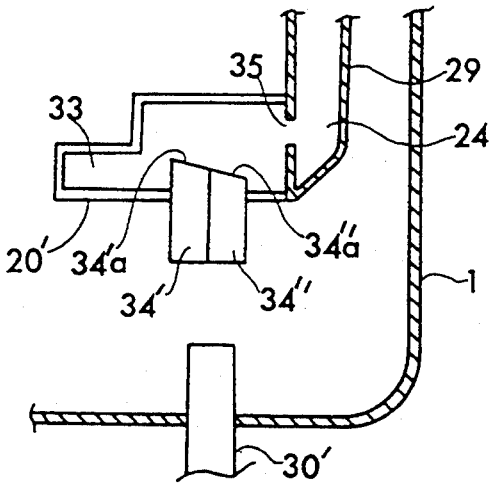
FIGS. 8(*b*) is an enlarged fragmentary sectional view of guide pipes of FIGS. 8(*a*), particularly showing a silencing hole.
Figure 8B:
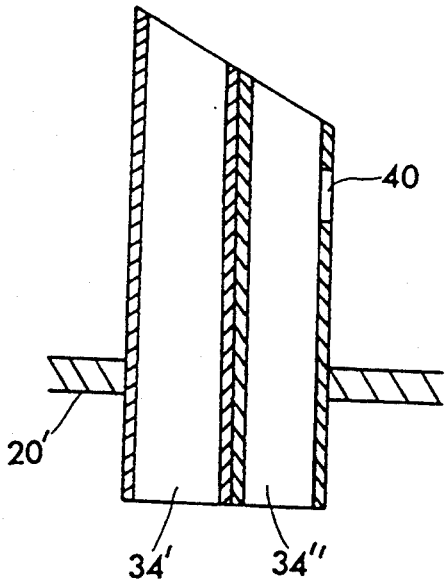

In addition, as shown in FIGS. 8(*a*), inclination portions 34'*a* and 34''*a*, with same incline positioned at the internal ends of the guide pipes 34' and 34'', decrease pressure loss by easy suction of refrigerant gas, and increase efficiency and reduce noise by diminished resistance.

Furthermore, with reference to FIGS. 8(*b*), noise in a certain band is eliminated by means of at least one silencing hole 40 formed on the side walls, which is positioned within the suction muffler 20' of the guide pipes 34' and/or 34'' of FIGS. 8(*a*).

Figure 9:
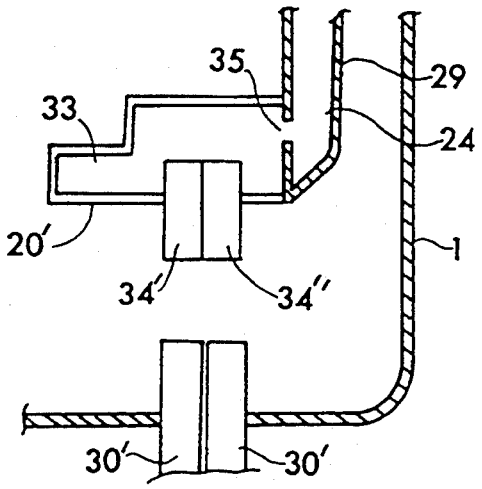

In FIG. 9, the number of the suction pipes 30' penetrating the casing 1 is increased to at least two according to the number of the guide pipes 34' and 34'' to improve efficiency and noise reduction by decreasing pressure loss by easy suction of refrigerant gas.

FIG. 9 is similar to FIG. 7(*a*), showing an increased number of suction pipes 30'. The present invention will now be illustrated by way of the following EXAMPLE.

EXAMPLE

Figure 1:
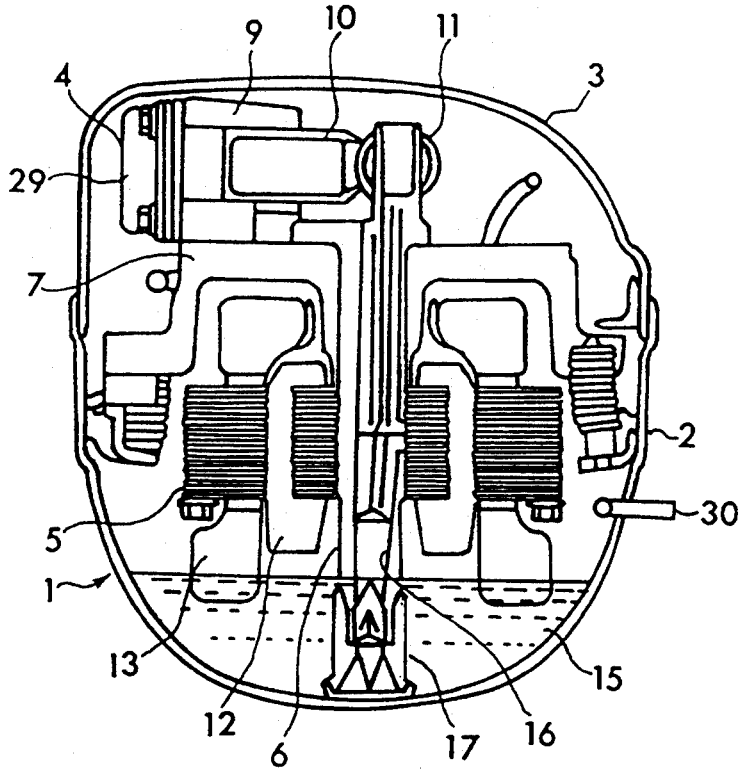
FIG. 1 PRIOR ART
FIG. 1 is a simplified side sectional view of a conventional hermetic compressor.
Figure 2:
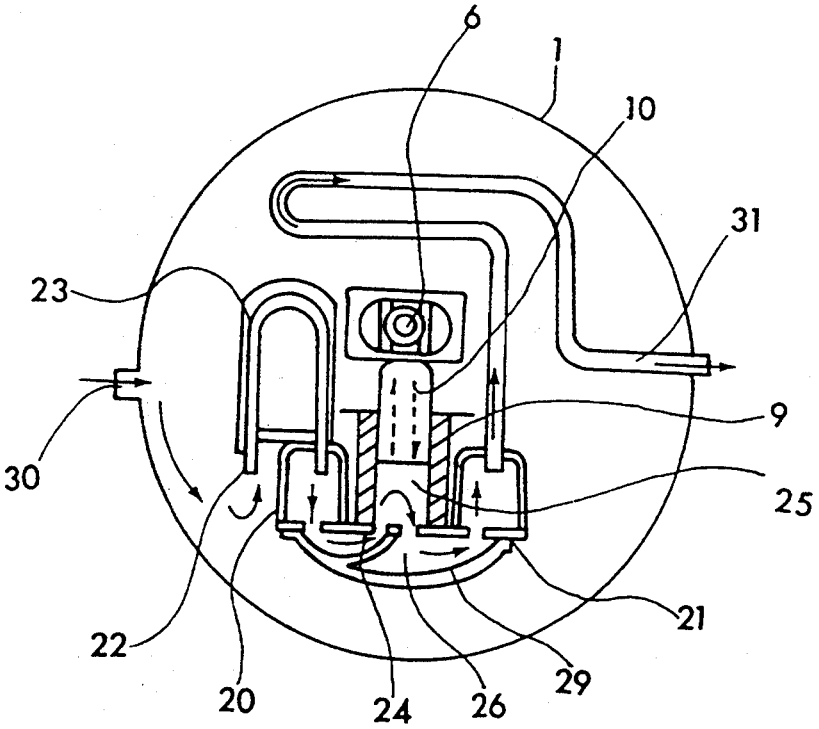
FIG. 2 PRIOR ART
FIG. 2 is a cross-sectional view of the conventional refrigerant suction and discharge apparatus for a hermetic compressor.

TABLE 1 shows characteristic comparison data of the conventional refrigerant suction and discharge apparatus for a hermetic compressor shown in FIG. 2 and the refrigerant suction add discharge apparatus for a hermetic compressor according to the present invention shown in FIGS. 5(*a*) and 5(*b*).

TABLE 1

| | | Conventional refrigerant suction and discharge apparatus | Refrigerant suction and discharge apparatus of the present invention |
|---|---|---|---|
| Refrigeration power (kcal/Hr) | | 50 | 57.2 |
| Input power (W) | | 72 | 75.4 |
| EER (BTU/WHr) | | 2.8 | 3.01 |
| Noise (dBA) | X direction | 43.8 | 41.2 |
| | Y direction | 43.3 | 41.3 |

As seen from TABLE 1, in the hermetic compressor including the refrigerant suction and discharge apparatus according to the present invention, efficiency is increased by about 14% and noise is reduced by 2.6dBA in X direction and 2dBA in Y direction compared with the conventional hermetic compressor shown in FIG. 2.

While specific embodiments of the invention have been illustrated and described wherein, it is be realized that modifications and changes will occur to those skilled in the art. It is therefore to be understood that the appended claims are intended to cover all modifications and changes as fall within the true spirit and scope of the invention.

What is claimed is:

1. A refrigerant suction and discharge apparatus for a hermetic compressor comprising at least one compression cylinder;

a suction pipe drawing refrigerant from the exterior of said hermetic compressor;

a suction muffler in communication with said at least one compression cylinder and having a hollow cavity at one side and, at another side, an intake opening which provides communication into the suction chamber; and at least two guide pipes for one compression cylinder, said guide pipes located adjacent to and opposite the outlet opening of said suction pipe to introduce refrigerant gas drawn from said suction pipe into said suction muffler.

2. A refrigerant suction and discharge apparatus for a hermetic compressor according to claim 1 wherein said guide pipes have different lengths.

3. A refrigerant suction and discharge apparatus for a hermetic compressor according to claim 1 wherein said guide pipes have different diameters.

4. A refrigerant suction and discharge apparatus for a hermetic compressor according to claim 1 wherein inclination portions having the same degree of inclination are formed at ends of said guide pipes which are within said suction muffler.

5. A refrigerant suction and discharge apparatus for a hermetic compressor according to claim 4 wherein at least one silencing hole is formed on a side wall of one of said guide pipes to eliminate noise in a certain frequency band.

6. A refrigerant suction and discharge apparatus for a hermetic compressor according to claim 1 wherein an expansion portion is formed at one end of said guide pipe.

* * * * *